US007549201B2

(12) United States Patent
Kraft et al.

(10) Patent No.: US 7,549,201 B2
(45) Date of Patent: Jun. 23, 2009

(54) ELASTIC SHOELACE

(75) Inventors: Sarah Kraft, Atlanta, GA (US); Deborah Rubin, Atlanta, GA (US); Lau P. Chiu, Hong Kong (CN)

(73) Assignees: Goody Products, Inc., Atlanta, GA (US); Goodway (Far East) Industrial Ltd. (HK)

( * ) Notice: Subject to any disclaimer, the term of this patent is extended or adjusted under 35 U.S.C. 154(b) by 389 days.

(21) Appl. No.: 11/329,311

(22) Filed: Jan. 10, 2006

(65) Prior Publication Data

US 2006/0168785 A1 Aug. 3, 2006

Related U.S. Application Data

(63) Continuation-in-part of application No. 11/272,996, filed on Nov. 14, 2005, now Pat. No. 7,305,996.

(60) Provisional application No. 60/643,198, filed on Jan. 12, 2005, provisional application No. 60/628,148, filed on Nov. 16, 2004.

(51) Int. Cl.
*A43C 9/06* (2006.01)

(52) U.S. Cl. ..... 24/713

(58) Field of Classification Search ..... None
See application file for complete search history.

(56) References Cited

U.S. PATENT DOCUMENTS

| | | | | |
|---|---|---|---|---|
| 1,066,759 | A | 7/1913 | Schloss | |
| 3,000,119 | A | 9/1961 | Altman | |
| 3,778,845 | A | 12/1973 | Miller | |
| 4,513,063 | A * | 4/1985 | Hashi et al. | 428/377 |
| 5,375,266 | A | 12/1994 | Michaud | |
| 5,727,574 | A | 3/1998 | Frye | |
| 5,758,671 | A | 6/1998 | Thim | |
| 5,787,904 | A | 8/1998 | Michaud | |
| 5,920,909 | A | 7/1999 | White et al. | |
| 6,000,408 | A | 12/1999 | Maturaporn | |
| 6,026,548 | A | 2/2000 | Jackson | |
| 6,079,236 | A | 6/2000 | Ives et al. | |
| 6,283,004 | B1 * | 9/2001 | Tseng | 87/6 |

(Continued)

FOREIGN PATENT DOCUMENTS

CN 200420095683.5 11/2004

(Continued)

OTHER PUBLICATIONS

International Search Report from PCT/US2005/41100 (5 pages).

(Continued)

*Primary Examiner*—Jack W. Lavinder
(74) *Attorney, Agent, or Firm*—Gardner Groff Greenwald & Villaneuva, PC

(57) ABSTRACT

An elastic shoelace includes a first end and a second end, an elongate elastic core, a sheath, and an elongate friction member. The elongate elastic core extends between the first and second ends of the elastic shoelace, and the sheath includes an outer surface and surrounds the elongate elastic core. The elongate friction member is disposed in the sheath, and at least a portion of the elongate friction member protrudes past the outer surface of the sheath.

12 Claims, 4 Drawing Sheets

U.S. PATENT DOCUMENTS

| | | | | |
|---|---|---|---|---|
| 6,493,910 | B1 | 12/2002 | Dischler | |
| 6,499,144 | B1 | 12/2002 | Yan | |
| 6,513,210 | B1 * | 2/2003 | Gonzalez | 24/712 |
| 6,516,637 | B1 | 2/2003 | Fancher et al. | |
| D479,393 | S * | 9/2003 | Weitzman | D2/978 |
| 6,681,459 | B1 | 1/2004 | Curet et al. | |
| 6,701,532 | B1 | 3/2004 | Glassberg et al. | |
| 6,711,749 | B2 | 3/2004 | Crisco | |
| 6,854,489 | B2 | 2/2005 | Tseng | |

FOREIGN PATENT DOCUMENTS

| | | |
|---|---|---|
| CN | 200420095684.X | 11/2004 |
| DE | 2041765 | 8/1970 |
| GB | 314707 | 8/1928 |
| GB | 814886 | 6/1954 |

OTHER PUBLICATIONS

Written Opinion from PCT/US2005/41100 (6 pages).

* cited by examiner

ELASTIC SHOELACE

RELATED APPLICATION DATA

The present application is a non-provisional application based on, and claiming the priority benefit of, U.S. provisional application Ser. No. 60/643,198, which was filed on Jan. 12, 2005, and is a continuation-in-part application based on co-pending U.S. application Ser. No. 11/272,996, which was filed on Nov. 14, 2005, and claims priority to U.S. provisional application Ser. No. 60/628,148, which was filed on Nov. 16, 2004. All of these applications are expressly incorporated herein by reference.

TECHNICAL FIELD

The present disclosure relates generally to an elastic shoelace and, more particularly, to an elastic shoelace having a woven exterior that includes a friction member.

BACKGROUND OF THE DISCLOSURE

Shoelaces have been utilized for many years as an apparatus for retaining shoes or other footwear on a user's feet. Such footwear includes boots and sports shoes/equipment, including, skates, running shoes, cleats, high-tops, tennis shoes, etc. Shoelace are traditionally constructed from a length of woven material having ends that include aglets for preventing fraying of the shoelace during use. Since the inception of the shoelaces, many have modified this traditional type shoelace.

For example, U.S. Pat. No. 6,854,489 to Tseng discloses a multi-purpose shoelace structure that comprises a shoelace flatly woven via multiple layers of side-by-side warps yarns and weft yarns interlacing back and forth the warp yarns thereof. When the shoelace is stringed through buttonholes of a shoe body and tied up into a knot, both ends of the shoelace are led through an elastic tying sections in the shoelace, thereby providing double protection in case the knot gets loose when the users are walking, running, or cycling. Both ends of the shoelace can also be led through the elastic tying sections in crisscross manner for more variety thereof.

In another example, U.S. Pat. No. 6,681,459 to Curet et al. discloses an adjustable shoelace that includes a stretchable string having a first cross sectional diameter at rest and a second smaller cross sectional diameter when stretched. An aglet having an inner cross sectional diameter that is smaller than the cross sectional diameter of the string at rest is positioned on the string. The aglet can be repositioned along the string by stretching the string such that the diameter of the string is approximate to the inner diameter of the aglet.

In another example, U.S. Pat. No. 6,493,910 to Dischler discloses method and apparatus having an enhanced knot retention. Specifically, method includes tying a knot and applying a fluid comprising a frictive agent to at least the tied knot, and then allowing the agent to dry.

In another example, U.S. Pat. No. 6,026,548 to Jackson discloses a system for securing a shoe. The system includes an elastic shoelace having a pair of ends that are covered with an elastomeric material, and a dual cord fastener that allow the shoelace ends to pass through and that locks the shoelace from moving relative to the fastener.

These shoelaces, however, even though they may contain features for adjusting or better retaining the shoelaces in a knot, do not address the issues resolved by the elastic shoelace of the present disclosure.

SUMMARY OF THE DISCLOSURE

In accordance with one aspect of the disclosure, an elastic shoelace having a first end and a second end, is disclosed. The elastic shoelace includes an elongate elastic core extending between the first and second ends, and a sheath having an outer surface surrounding the elongate elastic core. An elongate friction member is disposed in the sheath, such that at least a portion of the elongate friction member protrudes past the outer surface of the sheath.

In accordance with another aspect of the disclosure a shoelace having first and second ends, a core, a sheath surrounding the core, a friction member and a groove, is disclosed. The core extends between the first and second ends, and the sheath includes an outer surface. The friction member includes at least one section and is disposed in the sheath, such that at least a portion of the friction member protrudes past the outer surface of the sheath. The groove is defined by the at least one section of the friction member and is adapted to receive one of the first and second ends of the shoelace.

In accordance with another aspect of the disclosure, a method of retaining a shoe on a wearer's foot is disclosed. The method includes lacing an expandable shoelace including a friction member having at least one section through a plurality of eyelets of the shoe, tying a first free end and a second free end of the shoelace together, separating sides of an opening of the shoe such that a laced portion of the shoelace expands, inserting or removing the foot into or out-of the shoe, and releasing sides of the opening such that a force of the laced portion of the shoelace biases the sides toward each other.

Figure 1:
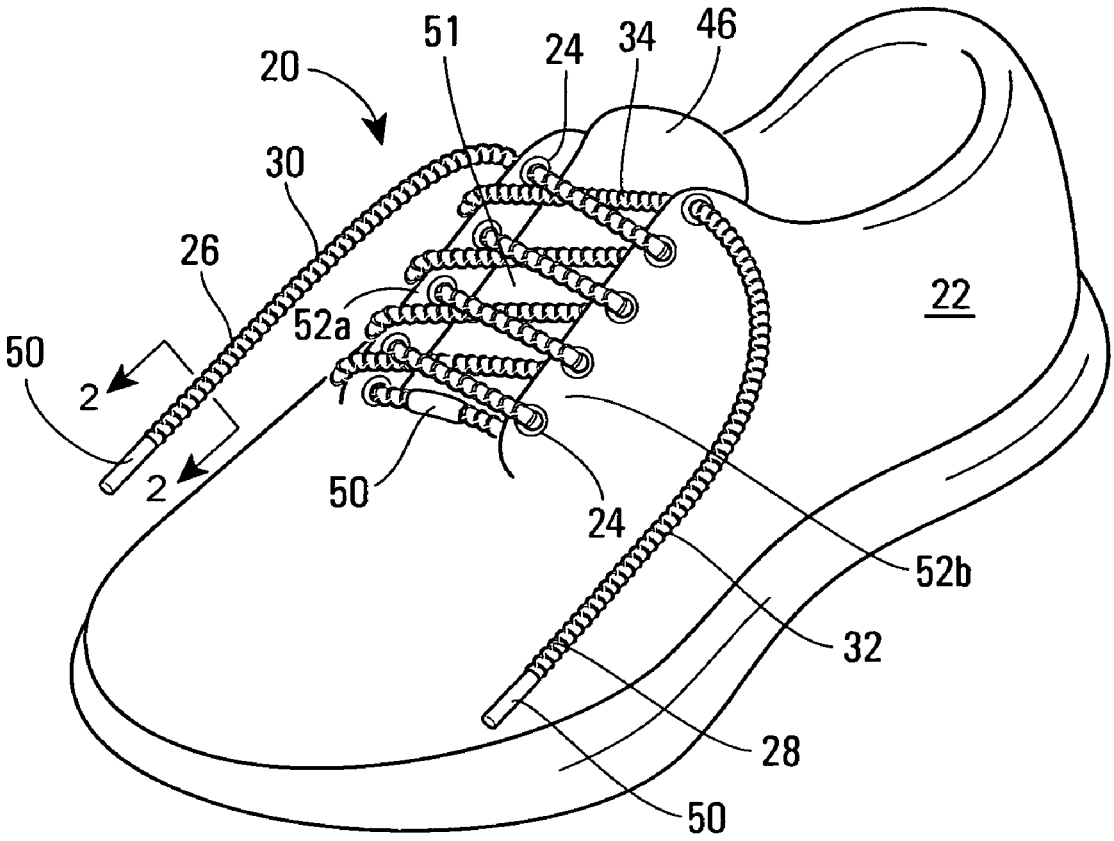
FIG. 1 is an isometric view of an elastic shoelace according to one embodiment of the disclosure on a shoe in an untied position.

While the method and device described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the disclosure and the appended claims.

DETAILED DESCRIPTION

Referring now to the drawings and with specific reference to FIG. 1, an elastic shoelace constructed in accordance with the teachings of the disclosure is generally depicted by reference numeral 20. The elastic shoelace 20 is disposed or threaded on a shoe 22 via a plurality of eyelets 24. Specifically, the elastic shoelace 20 includes a first distal end 26 and a second distal end 28 having disposed there between a first free end 30, a second free end 32, and a laced portion 34. The first free end 30 is disposed between the first distal end 26 and the laced portion 34 and is for connection or tying with the second free end 32 that is disposed between the second distal end 28 and the laced portion 34. The laced portion 34 is disposed between the first free end 30 and the second free end 32, and is disposed between the eyelets 24 of the shoe 22. In other words, the laced portion 34 is woven between the eyelets 24 of the shoe 22, and the first and second free ends or unlaced portions 30, 32 are formed by parts of the shoelace 20 extending beyond the eyelets 24 of the shoe 22.

Figure 2:
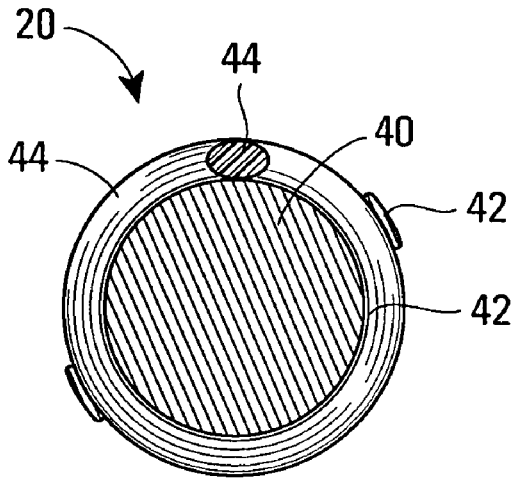
FIG. 2 is a cross-sectional view of the elastic shoelace along line 2-2 of FIG. 1.

As illustrated in more detail in FIG. 2, the elastic shoelace 20, in this exemplary embodiment, includes a core 40, a sheath 42, and a friction member 44. The elastic shoelace 20 is used to retain shoes on a user's feet. In particular, the friction member 44 prevents the elastic shoelace 20 from moving relative to various components of the shoe 22, such as a tongue 46 and the eyelets 24, and the elastic quality of the shoelace 20 allows the laced portion 34 of the shoelace 20 to expand and contract as needed. Specifically, the expansion of the shoelace 20 allows a user to remove or step into the shoe without disconnecting or untying the shoelace. Additionally, the elastic quality of the shoelace 20 allows the shoe to contract and expand as required by the user's foot, such as during a marathon, for example, without compromising the tightness or comfort of the shoes.

The core 40 of the elastic shoelace 20, as seen in FIG. 2, may be an elongate core 40 that is constructed from an elastic material, such rubber, plastic, natural rubber, silicone, or other elastic or visco elastic materials. The core 40 may be formed from one or more sections. For example, ends of the core 40 may be glued, melted, or stitched together, or may be connected by being covered in adhesive material or by being connected with a connection piece (such as one constructed of metal or plastic). The core 40 may have a generally circular cross-sectional area, as seen in FIG. 2, but may have other cross-sectional shape, such as rectangular, oval, square, triangular, etc. In addition, the elasticity or flexibility of the core 40 and the shoelace 20 may vary. For example, the elasticity of the shoelace may range from being very elastic to being stiff or rigid, such that the amount of stretch the shoelace 20 undergoes during use may range from large to none at all.

Figure 3:
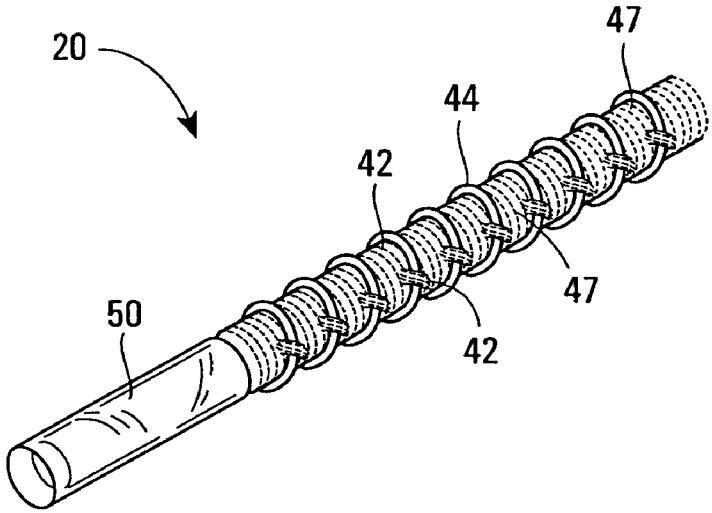
FIG. 3 is a detailed view of a portion of the elastic shoelace of FIG. 1.

The sheath 42 of the elastic shoelace 20, as seen in FIGS. 2 and 3, may be an elongate sheath 42 that is constructed from material, including but not limited to plastic, paper, cloth, and elastic or visco elastic materials, or the like. The sheath 42 may be a woven material, but may alternatively be constructed from a non-woven material as well, and may be constructed such that the sheath 42 can expand with the core 40 when the elastic shoelace 20 is stretched. The sheath 42 may surround the entire core 40 and, as such, may have a ring-like shape in the center of which is disposed the core 42. As seen in FIG. 3, the sheath 42 may be woven in a criss-cross pattern with the friction member 44 threaded or woven through the sheath 42. The friction member 44 may, in this exemplary embodiment, be part of the weave thereby replacing one or more of the threads or bunches of threads of the weave, or may be an addition to the weave, such that the friction member 44 is simply disposed between the previously woven sheath 42.

The friction member 44 may be disposed at a surface of the sheath 42 such that additional threads or bundles of threads may be woven around the friction member 44 with portions of the friction member 44 exposed through an exterior of the sheath 42 to the eyelets 24. Like the core 40, the sheath 42 may form a continuous loop, but may also contain breaks there between. The sheath 42 may be constructed from one single piece, but may also be constructed from a plurality of pieces, that may be connected in any known manner.

The friction member 44, as seen in FIGS. 2 and 3, may be constructed from a material that preferably has a higher friction coefficient that the material of which the sheath 42 is constructed and, as such, may be constructed from a positive friction material. The friction member 44 may be constructed from material including but not limited to plastic, rubber, natural rubber, silicone, or other elastic or visco elastic materials. The friction member 44 may have a round cross-sectional area, as seen in FIG. 2, but may have other cross-sectional shapes, such as rectangular, oval, square, triangular, etc.

The friction member 44 may be woven into the sheath 42 such that the friction member 44 becomes part of the woven sheath 42. In one exemplary embodiment, an outer surface of the friction member 44 may extend outwardly from an outer surface of the sheath 42, such that the friction member 44 may contact the object around which it is disposed. Additionally, the outer surface of the friction member 44 may abut the core 40 as seen in FIG. 2. As such, a cross-sectional area of the friction member 44 may be larger, or substantially larger, than a cross-sectional area of the material of which the woven sheath 42 is constructed, thereby ensuring that at least a part of the friction member 44 contacts the various component of the shoe 20. In this exemplary embodiment, the friction member 44 is disposed around the core 40 in a general helical or coil shape such that a groove 47 defined by the two rounds of the coil extents from the first distal end 26 to the second distal end 28 of the shoelace 20. Alternatively, the friction member 44 may be constructed from one or more section, such that the friction member includes a plurality of sections. For example, the friction member 44 may include a plurality of rings (not shown) disposed along and around the shoelace 20, such that a groove is disposed between each of the rings.

Figure 4:
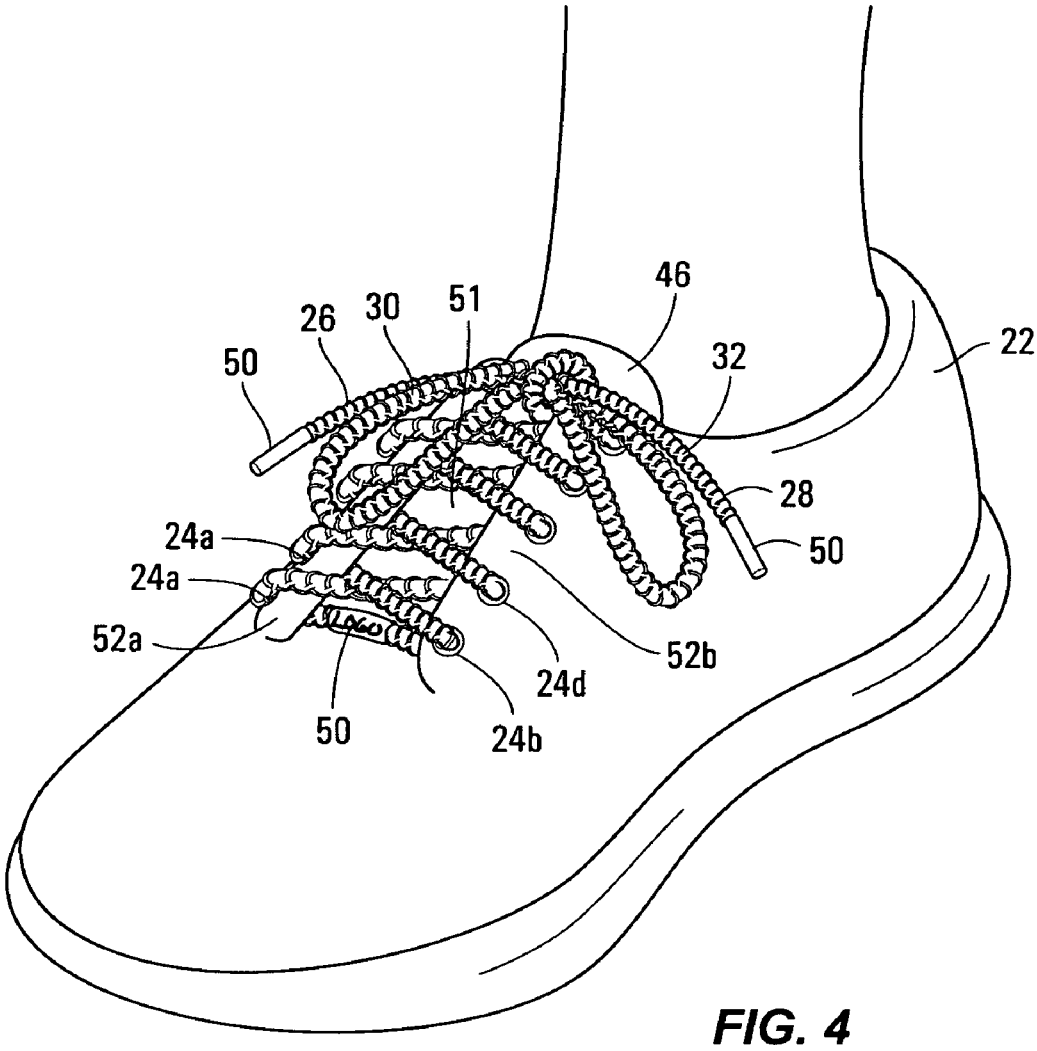
FIG. 4 is an isometric view similar to FIG. 1 with the user's foot in the shoe and the shoe being in a tied position.
Figure 7:
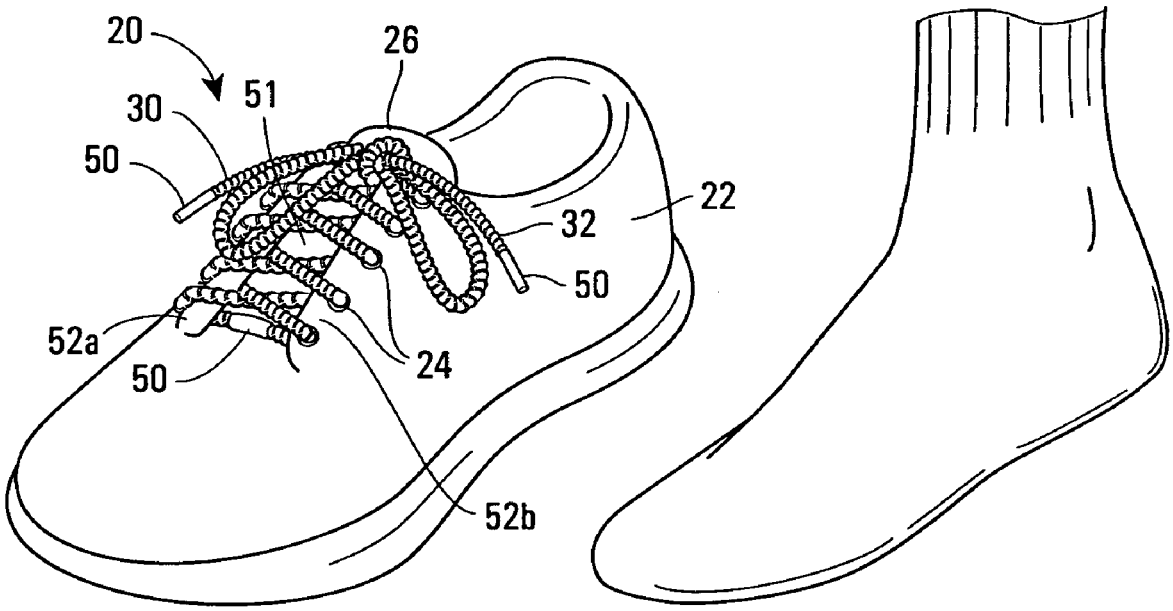
FIG. 7 is an isometric view similar to FIG. 4 with the user's foot outside the shoe and the shoe being in a tied position.

The above exemplary embodiment may include many variations thereof to achieve and/or create additional or alternative features. For example, the elastic shoelace 20 may include aglets 50 disposed at the first and second ends 26, 28, and/or along the length of the shoelace 20, as illustrated in FIGS. 4 and 7. The aglets 50 may provide a multitude of functions such as, for example, preventing the distal ends 26, 28 of the shoelace 20 from fraying and aiding the threading of the shoelace 20 through the plurality of eyelets 24. When disposed near a center of the shoelace 20, an aglet 50 may be used as a centering device when lacing the shoe 22. As illustrated in FIG. 4, the center aglet 50 may also be constructed to include an area for branding or to receive a logo.

The aglets 50 may be constructed from a variety of materials, including plastics, and may be attached or connected to the shoelace 20 via heat shrinking or other processes know to those of ordinary skill in the art. The sheath 42 may be constructed from a maypole braiding weaving pattern. The friction member 44 may be attached to the elastic shoelace 20 in alternate ways including but not limited to gluing the friction member 44 to the elastic shoelace 20, such as with hot melt glue or cyanoacrylate glue, and stitching the friction member 44 to the sheath 42. The adhesive can be applied at intervals along the length of the product to allow the stretch properties required for use to still be intact.

The elastic shoelace 20 may be manufactured using any known braiding or weaving system or method including but not limited to a maypole braiding system and a flat braiding system. The maypole braiding system forms strands or fabrics by an operation commonly known as braiding or plating. Bobbins, or carriers having bobbins thereon, travel in predetermined paths. The carriers either pass each other so as to interlace the strands, or the strands leading from bobbins are caused to pass other bobbins to cause interlacing of the strands. The flat braiding system weaves three or more strands into a single braid by interlacing the strands longitudinally over one another.

In another exemplary embodiment, the shoelace 20 may be manufactured from a visco-elastic material, such as rubber, plastic, natural rubber, silicone, or the like, for example. As a result, one or more of the core 40, the sheath 42, and the friction member 44 may be combined and constructed as an integral piece, while still providing the exterior structures of the shoelace 20. More specifically, regardless of whether the core 40, the sheath 42, and/or the friction member 44 are integrally formed, the shoelace 20 still includes the one or more friction members 44, be it in the from of rings or a helical shape, and the one or more grooves 47. In this embodiment, the shoelace 20 may be manufactured via a one step injection molding or extruded and stamped or rolled process.

In operation, the shoelace 20 may be used with any variety of footwear requiring shoelaces, including boots, shoes, sport footwear, such as tennis shoes, running shoes, etc. and, in this exemplary embodiment, will be described as being worn on a running shoe 22. The running shoe 22 includes the tongue 46 that is disposed in and covers an opening 51 in the shoe 22. The opening 51 includes at least two sides 52*a*, 52*b* having the eyelets 24 disposed thereon. The shoelace 20 may be threaded or laced through the eyelets 24 of the shoe 22 in any manner including, but not limited to, criss-cross lacing, over-under lacing, straight lacing, sawtooth lacing, ladder lacing and the like.

Once the shoelace 20 is laced onto the shoe 22, for example, as illustrated in FIG. 1, the shoelace 20 is ready to be tied or connected, thereby bringing the sides 52*a*, 52*b* of the opening 51 together to surround the foot of the wearer. Similarly, various sections of the laced portion 34 of the shoelace 20 are now disposed between various eyelets 24. Specifically, as illustrated in FIG. 4, various section of the laced portion 34 are disposed between eyelets 24*a* and 24*b*, and eyelets 24*c* and 24*d*, etc. respectively.

Prior to connecting or tying a knot in the shoelace 20, as illustrated in FIG. 1, the user may pull on the free ends 30, 32 in an effort to tighten the shoelace 20 and force the sides 52*a*, 52*b* of the opening 51 toward each other. The shoelace 20 may then be connected, knotted or tied together with the free ends 30, 32, as illustrated in FIG. 4. This connection may be accomplished using one of the many knots, bows, or other connection methods known to those of ordinary skill in the art.

Once the shoe 22 is secured to the user's foot, as illustrated in FIG. 4, the knot created with the first and second free ends 30, 32, holds the shoelace 20 in place such that sides 52*a*, 52*b* of the opening 51 are biased together so that the shoe 22 fits snuggly on the wearer's foot. In addition, the knot prevents the first and second free ends 30, 32 from becoming shortened as the laced portion 34 becomes larger due to the inherent separation of the sides 52*a*, 52*b* of the opening 51 caused from walking or running in the shoe 22.

The shoelace 20 in this closed or tied position secures the foot in the shoe 22. In addition, due to the elastic property of the shoelace 20, the shoelaces 20 and, specifically, the various sections of the laced portion 34 of the shoelace 20 disposed between the eyelets 24 will expand if needed. For example, if a user is running or is engaged in an activity that causes the user's foot to swell, the laced portion 34 of the shoelace 20 will expand, thereby allowing the opening 51 to widen for accommodating the additional volume of the foot caused by the swelling.

Figure 5:
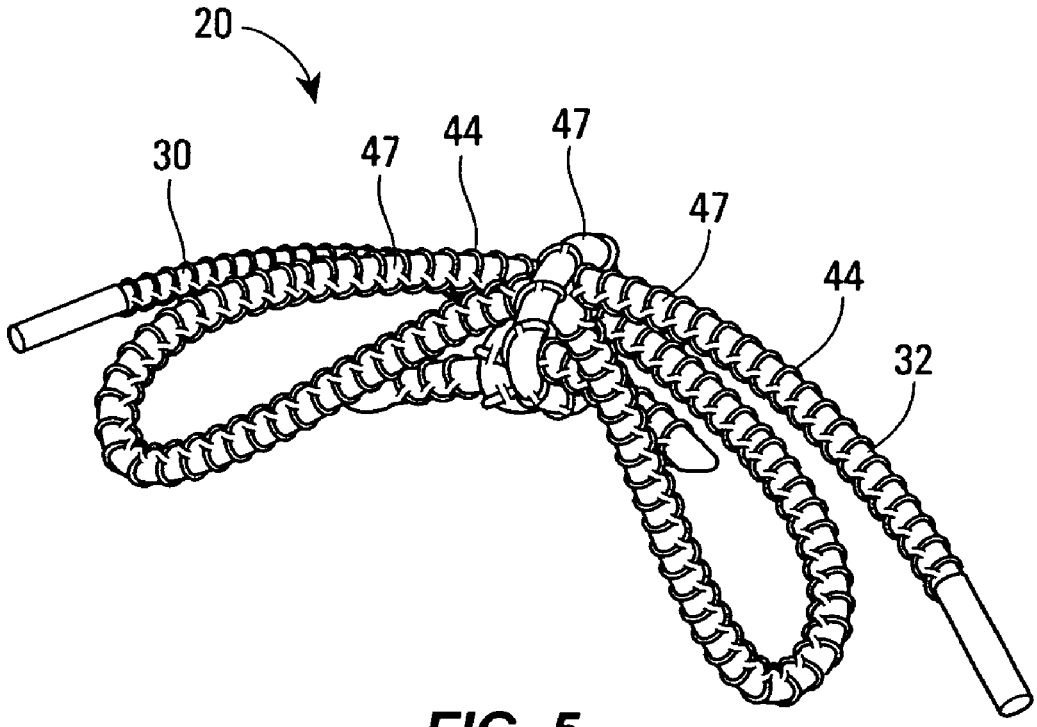
FIG. 5 is a detailed view of the knot in FIG. 4 using the elastic shoelace.
Figure 6:
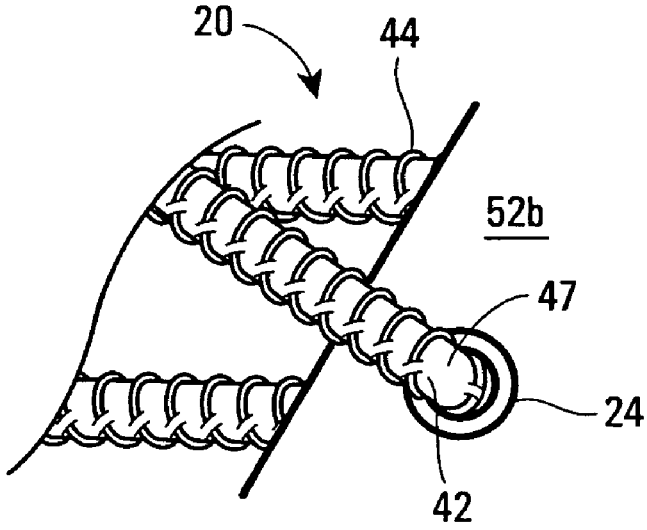
FIG. 6 is a detailed view of an engagement between the elastic shoelace and an eyelet of FIG. 4.

The friction member 44, being disposed on the first and second free ends 30, 32, aids in the retention of the knot or connection, as illustrated in FIG. 5. Specifically, when the shoelace 20 is in the closed or tied position, the friction member 44 on both the first and second free ends 30, 32 are compressed, due to the nature of the knot, and abut the other of the first and second free ends 30, 32 including the friction member 44 itself, thereby preventing slippage between the first and second free ends 30, 32. In addition, the friction member 44 disposed along the first free end 30, for example, defines a groove 47 in which the second free end 32 is engaged or disposed when the shoelace 20 is in the closed or tied position. As a result, the second free end 32 has a coil of or a section of the friction member 44 on either side, thereby trapping or second free end 32 in the groove 47 and preventing movement of the first and second free ends 30, 32 relative to each other. Similarly, as illustrated in FIG. 6, the groove 47 disposed on the laced portion 34 may align with an edge of the eyelets 24, thereby preventing movement of the laced portion 34 relative to the shoe 22.

Once the shoelace 20 is in the closed or tied position, the user may remove the foot from the shoe 22 without untying or disconnecting the first and second free ends 30, 32 as illustrated in FIG. 7. The foot can be removed due to the elastic property of the shoelace 20 as the shoelace 20 will expand a sufficient length to enable the opening 51 to become sufficiently large.

In particular, the foot may be inserted or removed by pulling outwardly the tongue 46 or sides 52*a*, 52*b* of the opening 51, to cause portions of the shoelace 20 between the eyelets 24 to stretch. Once the foot is inserted or removed, the tongue 46 or sides 52*a*, 52*b* release to allow portions of the shoelace 20 between the eyelets 24 to return toward normal length and pull sides 52*a*, 52*b* of the opening 51 toward each other.

In one exemplary embodiment, the various portions of the shoelace disposed between the eyelets 24 will not move relative to the eyelets 24 during the removal or use of the shoe 22. For example, as illustrated in FIG. 6, the laced portion 34 may align with an edge of the eyelets 24, thereby preventing movement of the laced portion 34 relative to the shoe 22. The prevention of this movement, allows the sections of the laced portion 34 to remain the same between the eyelets 24, such as the eyelets 24*a* and 24*b*, and eyelets 24*c* and 24*d* (FIG. 4), etc., for example. More specifically, in prior art shoelaces the amount of the shoelace disposed between the respective eyelets will vary during use of the shoe, as there are no measures to prevent movement of the shoelace relative to the eyelets. In this exemplary embodiment, however, the friction member 44 and, in particular the groove 47, engages the eyelets 24, such that the amount of the shoelace 20 disposed between the respective eyelets 24 does not vary during use.

The shoe 22 may, of course, be worn again without having to untie or disconnect the knot or connection between the first and second free ends 30, 32 to get the foot into the shoe 22. As a result, the user may tie or connect the shoe 22 as desired for a single time, including the proper tightness of the shoe 22 and the orientation/location of the knot, without changing the same after having removed and again wearing the shoe 22.

While the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. An elastic shoelace for a shoe, comprising:

a first end and a second end;

an elongate elastic core extending between the first and second ends;

a sheath surrounding the elongate elastic core, the sheath having an outer surface; and an elongate friction member disposed in the sheath, wherein at least a portion of the elongate friction member protrudes past the outer surface of the sheath, wherein the elongate friction member is fabricated from a material having a greater coefficient of friction than the material from which the sheath is fabricated, wherein the elongate friction member is disposed around the core in a helical manner, and wherein a helical groove is defined between adjacent segments of the elongate friction member such that when two portions of the shoelace are laced through the shoe and overlap, a segment of the groove of the first portion retains a segment of the elongate friction member of the second, overlapping portion of the friction member.

2. The elastic shoelace of claim 1, wherein the sheath is constructed from a woven fabric.

3. The elastic shoelace of claim 1, wherein the elongate friction member is woven into the sheath.

4. The elastic shoelace of claim 1, further including a first aglet disposed at the first end of the shoelace and a second aglet disposed at a second end of the shoelace.

5. The elastic shoelace of claim 1, wherein the core is constructed from at least one of a rubber, plastic, natural rubber, and silicone material.

6. The elastic shoelace of claim 1, wherein the elongate friction member extends from the first to the second end of the shoelace.

7. The elastic shoelace of claim 4, further including a third aglet disposed near a center of the shoelace.

8. The elastic shoelace of claim 7, wherein the third aglet is adapted to receive a branding or a logo.

9. The elastic shoelace of claim 1, wherein the elongate friction member is elastic.

10. A shoelace comprising:

a first end and a second end;

an elastic core extending between the first and second ends;

a sheath surrounding the core, the sheath having an outer surface;

a friction member, the friction member being disposed helically in the sheath, wherein at least a portion of the friction member protrudes past the outer surface of the sheath and wherein the friction member is fabricated from a material having a greater coefficient of friction than the material from which the sheath is fabricated; and a groove defined between adjacent segments of the friction member, wherein the groove is adapted to receive and retain an overlapping portion of the shoelace.

11. The shoelace of claim 10, further including a first aglet disposed at the first end of the shoelace and a second aglet disposed at the second end of the shoelace.

12. The elastic shoelace of claim 11, further including a third aglet disposed near a center of the shoelace.

* * * * *

UNITED STATES PATENT AND TRADEMARK OFFICE

CERTIFICATE OF CORRECTION

PATENT NO. : 7,549,201 B2
APPLICATION NO. : 11/329311
DATED : June 23, 2009
INVENTOR(S) : Sarah Kraft et al.

It is certified that error appears in the above-identified patent and that said Letters Patent is hereby corrected as shown below:

Title Page, item 75
The correct name of the listed inventor "Lau P. Chiu" is "Lau, P. Chiu" (the surname is "Lau" not "Chiu"). Also, a Certificate of Correction is being contemporaneously filed in the parent Patent 7,305,996 (also known as application serial number 11/272,996).

Signed and Sealed this

First Day of June, 2010

David J. Kappos

David J. Kappos
*Director of the United States Patent and Trademark Office*